US008647142B1

(12) United States Patent
Kershaw

(10) Patent No.: US 8,647,142 B1
(45) Date of Patent: Feb. 11, 2014

(54) RETAINER FOR MAINTAINING ELECTRICAL POWER PLUG CONNECTION TO ELECTRICAL POWER RECEPTACLE

(76) Inventor: David Michael Kershaw, Kingston Springs, TN (US)

( * ) Notice: Subject to any disclaimer, the term of this patent is extended or adjusted under 35 U.S.C. 154(b) by 0 days.

(21) Appl. No.: 13/327,835

(22) Filed: Dec. 16, 2011

(51) Int. Cl.
*H01R 13/62* (2006.01)

(52) U.S. Cl.
USPC ..... 439/373; 439/368

(58) Field of Classification Search
USPC ..... 439/368, 369, 371, 373
See application file for complete search history.

(56) References Cited

U.S. PATENT DOCUMENTS 5,928,023 A * 7/1999 Buckner et al. ..... 439/373
6,159,034 A * 12/2000 Royer ..... 439/373
6,939,161 B1 * 9/2005 Yi et al. ..... 439/373
7,056,145 B2 * 6/2006 Campbell et al. ..... 439/373
7,559,788 B2 * 7/2009 Legg ..... 439/373
7,563,123 B2 * 7/2009 Cave ..... 439/373
7,749,015 B2 * 7/2010 Uchikawa et al. ..... 439/362

* cited by examiner

*Primary Examiner* — Thanh Tam Le
(74) *Attorney, Agent, or Firm* — Waddey & Patterson, P.C.; Ryan D. Levy

(57) ABSTRACT

A retainer comprises at least two retaining straps or retainer screws and a retainer plate having a cord hole, a slot, and a plurality of retainer holes or retainer strap notches. The retainer maintains connection of an electrical power plug at an end of an electrical power cord to an electrical power receptacle when the retainer is installed. The cord hole and slot extend through the retainer plate, and the slot extends from an edge of the retainer plate to the cord hole. Each of the at least two retaining straps is operable to engage a retainer hole or retaining strap notch in the retainer plate and extend from the retainer plate around the electrical power receptacle and back to the retainer plate.

20 Claims, 2 Drawing Sheets

RETAINER FOR MAINTAINING ELECTRICAL POWER PLUG CONNECTION TO ELECTRICAL POWER RECEPTACLE

FIELD

The invention relates to an apparatus for maintaining an electrical connection between an electrical power receptacle and an electrical plug at an end of an electrical power cord.

BACKGROUND

Maintaining power to machines in data centers is important to the functionality of the data center. For example, power loss at a computer readable media storage array can cause loss of data, data corruption, and data unavailability. Power loss at a computing array can cause data loss, website down time, slow inquiry response, and resource unavailability. These issues are time consuming and expensive to resolve. Therefore, data centers take a number of measures to ensure power availability at the facility such as multiple backup generators, battery backups, and uninterruptible power supplies. However, none of these measures are effective if an electrical plug at the end of an electrical power cord supplying power to a machine or machines is physically disconnected from an electrical power receptacle (e.g., power outlet). Accidentally disconnecting a power connection is a common occurrence in data centers. The long and numerous electrical cords and data cables in the facility become entangled. When a technician is pulling an electrical power cord or data cable out of a cable run, the electrical power cord or data cable pulls another electrical cord with which it is entangled out of its corresponding electrical receptacle.

SUMMARY

In one aspect, a retainer plate of a retainer for maintaining connection of an electrical power plug at an end of an electrical power cord to an electrical power receptacle includes a substantially planar body, a cord hole, and a slot. The hole and the slot extend through the substantially planar body. The slot extends from an edge of the substantially planar body to the cord hole.

In one aspect a retainer includes a retainer plate, a cord hole, a slot, at least two retaining straps, and a plurality of retainer holes or retainer strap notches. The retainer maintains connection of an electrical power plug at an end of an electrical power cord to an electrical power receptacle when the retainer is in use. The cord hole and slot extend through the retainer plate, and the slot extends from an edge of the retainer plate to the cord hole. Each of the at least two retaining straps is operable to engage a retainer hole or retaining strap notch in the retainer plate and extend from the retainer plate around the electrical power receptacle and back to the retainer plate. The retaining strap is one of a cable tie, a zip tie, elastic strap, and a hook and loop fastener. The plurality of retainer holes each extend through the retainer plate, and each is sized to receive at least one retaining strap. Alternatively, a plurality of retaining strap notches in a perimeter of the retainer plate are each sized to receive at least one retaining strap. The cord hole is between the at least two retaining straps when the electrical power plug is in the electrical power receptacle, the electrical power cord is in the cord hole, and the at least two retaining straps are extending from the retainer plate around the electrical power receptacle and back to the retaining plate.

In one aspect, a retainer includes a retainer plate, a cord hole, a slot, at least two retainer screws, and at least two retainer holes. The retainer maintains connection of an electrical plug at an end of an electrical power cord to an electrical power receptacle when in use. The cord hole and slot extend through the retainer plate, and the slot extends from an edge of the retainer plate to the cord hole. At least two retainer screws are sized to engage threads of the electrical power receptacle and extend through the retainer plate into the threads of the electrical power receptacle. At least two retainer holes extend through the retainer plate, and each retainer hole has a dimension that is larger than a diameter of shank of a retainer screw and less than a diameter of a head of the retainer screw. The cord hole is between the at least two retainer holes.

BRIEF DESCRIPTION OF THE DRAWINGS

Non-limiting and non-exhaustive embodiments are described with reference to the following figures, wherein like reference numerals refer to like parts throughout the various drawings unless otherwise specified.

DETAILED DESCRIPTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
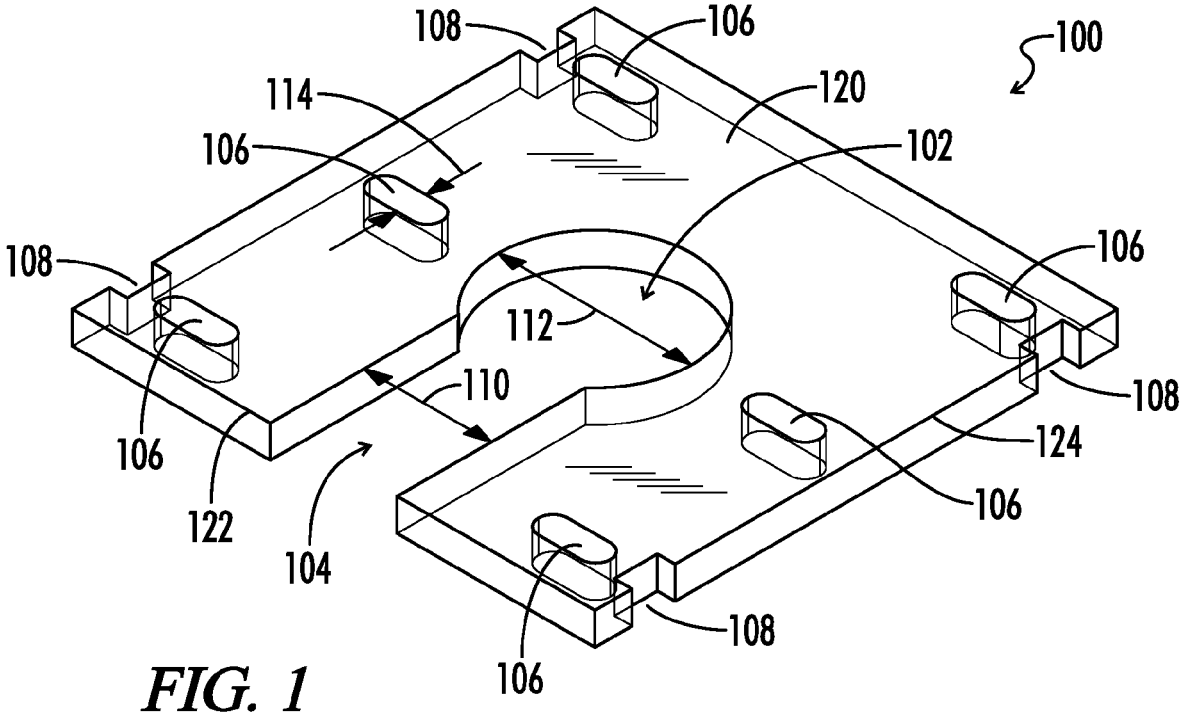
FIG. 1 is an elevated perspective view of a retainer plate.

Referring to FIG. 1, one embodiment of a retainer plate 100 includes a substantially planar body 120, a cord hole 102, a slot 104, a plurality of retainer holes 106, and a plurality of retainer notches 108. The retainer plate 100 maintains connection of an electrical power plug at an end of an electrical power cord to an electrical power receptacle when installed. The cord hole 102 and slot 104 extend through the substantially planar body 120. The cord hole 102 may be substantially centered in the substantially planar body 120, and the slot 104 extends from an edge 122 of the substantially planar body 120 to the cord hole 102. Each of the plurality of retainer holes 106 extends through the substantially planar body 120 and is sized to receive at least one retaining strap (not shown, see FIG. 2). A perimeter 124 of the substantially planar body 120 has a plurality of retaining strap notches 108, each sized to receive a retaining strap (not shown). In one embodiment, a length of the substantially planar body 120 is less than a length of the electrical power receptacle, and a width of the substantially planar body 120 is less than a width of the electrical power receptacle.

In one embodiment, the retainer holes 106 and/or the retaining strap notches 108 are positioned such that the cord hole 102 is between the at least two retaining straps when the electrical power plug is in the electrical power receptacle, the electrical power cord is in the cord hole 102, and the at least two retaining straps are extending from the substantially planar body 120 around the electrical power receptacle and back to the substantially planar body 120 (i.e., when the retainer plate 100 is installed).

In one embodiment, the retainer holes 106 have a minimum dimension 114 (e.g., a width or diameter) that is larger than a diameter of a shank of a retainer screw and less than a diameter of a head of the retainer screw. In this embodiment, when the electrical power plug is in the electrical power receptacle and the retainer plate is maintaining connection of the electrical power plug to the electrical power receptacle, the retainer holes 106 are positioned such that the cord hole 102 is at least partially between two retainer holes 106.

In one embodiment, the substantially planar body 120 is slightly concave along to at least one axis to improve resistance to a bending moment when installed.

Figure 2:
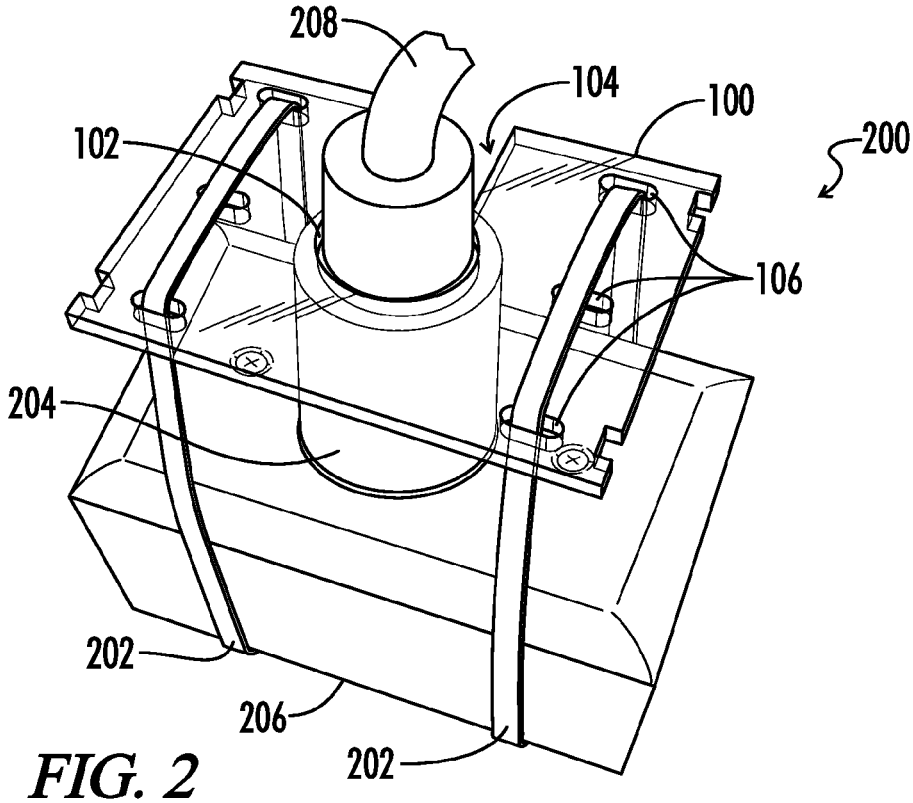
FIG. 2 is an elevated perspective view of a retainer installed on an electrical power receptacle and electrical plug at the end of an electrical power cord using retaining straps.

Referring to FIG. 2, a retainer 200 includes the retainer plate 100 of FIG. 1 and retaining straps 202 installed through retainer holes 106. The retaining plate 100 is installed on the electrical power cord 208 such that the electrical power cord 208 extends through the cord hole 102. An electrical power plug 204 at an end of an electrical power cord 208 is inserted into an electrical power receptacle 206. The retaining straps 202 extend from the retaining plate 100 around an electrical power receptacle 206, and back to the retaining plate 100. The retaining straps 202 are one of a cable tie, a zip tie, or a hook and loop fastener (e.g., Velcro). It is contemplated that retaining straps 202 may also be rubber bands, string, wire, metal clips, or other fastening devices. In one embodiment, the retaining straps are inelastic. In one embodiment, retainer holes 106 or retainer notches 108 are positioned such that a retaining strap 202 extends across the slot 104, when the retainer 200 is installed such that the electrical power cord 208 is trapped in the cord hole 102 by a retaining strap 202.

In one embodiment, the retainer plate 100 is resiliently deformable. For example, the retainer plate 100 is made of a plastic that is capable of being deformed, but tends to return to its substantially planar shape. In this embodiment, the slot 104 has a minimum dimension 110 (e.g., a width) that is less than a minimum dimension of the electrical power cord 208 (i.e., a diameter of a round power cord or a minimum width of a power cord having an oblong cross section), and the cord hole has a minimum dimension 112 (e.g., a width or diameter) that is greater than a maximum dimension (e.g., a width or diameter) of the electrical power cord 208 and less than a maximum dimension (e.g., a width or diameter) of the electrical power plug 204. Thus, to position the retainer plate 100 on the electrical power cord 208, the substantially planar body 120 is deformed by an installer to slip the electrical power cord 208 through the slot 104 and into the cord hole 102. Once the electrical power cord 208 is in the cord hole 102, the installer stops applying a twisting force to the substantially planar body 120, and the substantially planar body 120 returns to its planar shape.

In another embodiment, the retainer plate 100 is rigid. For example, the retainer plate 100 is made of a plastic or polycarbonate that is not capable of significant deformation without damage to the structure of the retainer plate 100. In some embodiments, the design can be made from plenum rated materials. In this embodiment, the slot 104 has a minimum dimension that is at least as great as a maximum dimension of the electrical power cord 208 and less than a maximum dimension of the electrical power plug 204. The cord hole 102 has a minimum dimension that is greater than a minimum dimension of the slot 104 and less than a maximum dimension of the electrical power plug 204 at the end of the electrical power cord 208. To install the retainer plate 100 on the electrical power cord 208, the installer slips the slot 104 over the electrical power cord 208. The installer completes installation of the retainer 200 by putting retaining straps through the retainer holes 106 and tightening them around the electrical receptacle 206.

Figure 3:
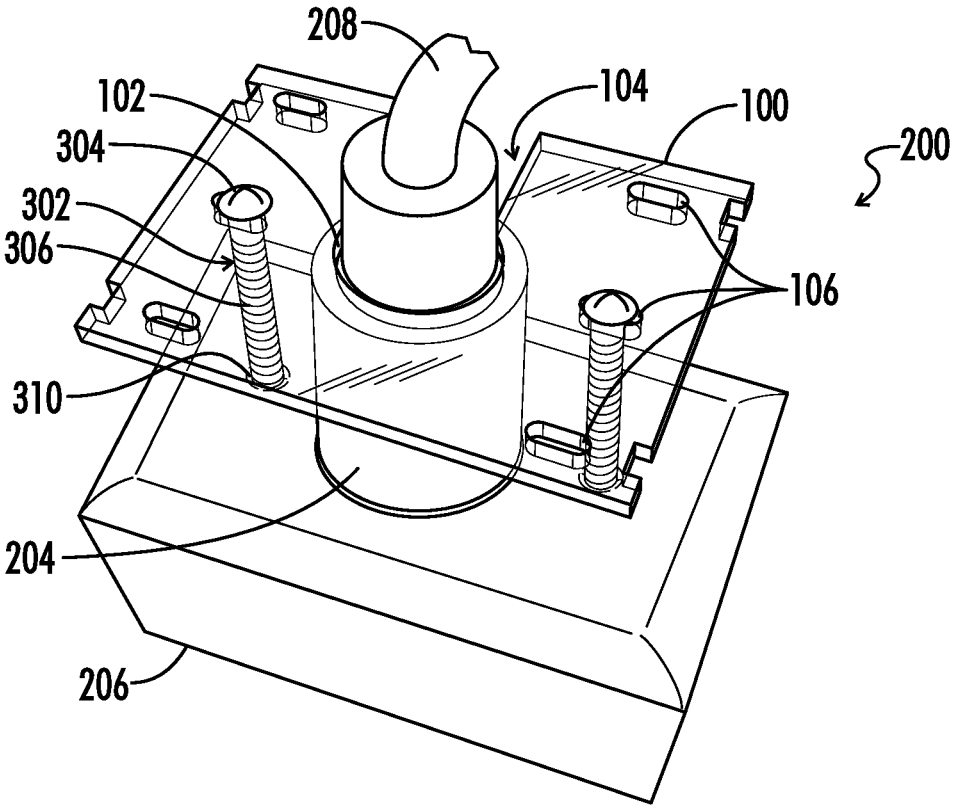
FIG. 3 is an elevated perspective view of a retainer installed on an electrical power receptacle and electrical plug at the end of an electrical power cord using retaining screws.

Referring to FIG. 3, the retainer plate 100 is installed on the electrical power plug 204 at the end of the electrical cord 208 and secured to the electrical power receptacle 206 using retaining screws 302. Each retaining screw 302 is fitted through a retainer hole 106 in the retaining plate 100 and screwed into threaded holes 310 in the electrical power receptacle 206. A diameter of a head 304 of each retaining screw 302 is larger than a minimum dimension 114 (see FIG. 1) of the retainer hole 106. A shank 306 of the retaining screw 302 has threads matching threads of the threaded hole 310 of the electrical power receptacle 206. In one embodiment, the retaining screws 302 are hex head bolts or other threaded fasteners.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

What is claimed is:

1. A retainer plate of a retainer for maintaining connection of an electrical plug at an end of an electrical power cord to an electrical power receptacle, said retainer plate comprising:

a substantially planar body;

a cord hole through the substantially planar body;

a slot through the substantially planar body from an edge of the substantially planar body to the cord hole through the substantially planar body; and at least two retainer holes through the substantially planar body, each retainer hole having a dimension that is larger than a diameter of a shank of a retainer screw and less than a diameter of a head of the retainer screw, wherein the cord hole is at least partially between the at least two retainer holes.

2. The retainer plate of claim 1, wherein:

the substantially planar body is resiliently deformable;

the slot through the substantially planar body has a minimum dimension that is less than a minimum dimension of the electrical power cord; and the cord hole through the substantially planar body has a minimum dimension that is greater than the minimum dimension of the slot through the substantially planar body and less than a maximum dimension of the electrical power plug at the end of the electrical power cord.

3. The retainer plate of claim 1, wherein:

the substantially planar body is rigid;

the slot through the substantially planar body has a minimum dimension that is at least as great as a maximum dimension of the electrical power cord and less than a maximum dimension of the electrical power plug at the end of the electrical power cord; and the cord hole through the substantially planar body has a minimum dimension that is greater than the minimum dimension of the slot through the substantially planar body and less than a maximum dimension of the electrical power plug at the end of the electrical power cord.

4. The retainer plate of claim 1, further comprising:

a plurality of retainer holes through the substantially planar body, each retainer hole having an opening to receive at least one retaining strap there through; or a plurality of retaining strap notches in a perimeter of the substantially planar body, each notch having an opening to receive at least one retaining strap there through;

wherein the plurality of retainer holes or retaining strap notches are positioned such that the cord hole is between the at least two retaining straps when the electrical power plug is in electrical power receptacle, the electrical cord is in the cord hole, and the at least two retaining straps are extending from the substantially planar body around the electrical power receptacle and back to the substantially planar body.

5. The retainer plate of claim 1, wherein a length of the substantially planar body is less than a length of the electrical power receptacle, and a width of the substantially planar body is less than a width of the electrical power receptacle.

6. The retainer plate of claim 1, wherein:

the cord hole through the substantially planar body is in an interior portion of the substantially planar body; and the cord hole through the substantially planar body is centered in the substantially planar body.

7. A retainer for maintaining connection of an electrical plug at an end of an electrical power cord to an electrical power receptacle, said retainer comprising:

a retainer plate;

a cord hole through the retainer plate;

a slot through the retainer plate from an edge of the retainer plate to the cord hole through the retainer plate;

retaining straps, each retaining strap operable to engage retainer holes or retaining strap notches in the retainer plate and extend from the retainer plate around the electrical power receptacle and back to the retainer plate; and the retainer holes extending through the retainer plate, each retainer hole having an opening sized to receive at least one of the retaining straps; or the retaining strap notches in a perimeter of the retainer plate, each retaining strap notch sized to receive at least one of the retaining straps, wherein the cord hole is between the at least two retaining straps when the electrical power plug is in electrical power receptacle, the electrical cord is in the cord hole, and the at least two retaining straps are extending from the retainer plate around the electrical power receptacle and back to the retaining plate.

8. The retainer of claim 7, wherein:

wherein each retaining strap is one of a cable tie, a zip tie, and a hook and loop fastener;

the retainer plate is resiliently deformable;

the slot through the retainer plate has a minimum dimension that is less than a minimum dimension of the electrical power cord; and the cord hole through the retainer plate has a minimum dimension that is greater than the minimum dimension of the slot through the retainer plate and less than a maximum dimension of the electrical power plug at the end of the electrical power cord.

9. The retainer of claim 7, wherein:

the retainer plate is rigid;

the slot through the retainer plate has a minimum dimension that is at least as great as a maximum dimension of the electrical power cord and less than a maximum dimension of the electrical power plug at the end of the electrical power cord; and the cord hole through the retainer plate has a minimum dimension that is greater than the minimum dimension of the slot through the retainer plate and less than a maximum dimension of the electrical power plug at the end of the electrical power cord.

10. The retainer of claim 7, wherein when plug is in electrical power receptacle, the electrical cord is in the cord hole, and the at least two retaining straps are extending from the retainer plate around the electrical power receptacle and back to the retaining plate, one of the at least two retaining straps extends across the slot through the retainer plate.

11. The retainer of claim 7, further comprising:

retainer screws sized to engage threads of the electrical power receptacle and extend through the retainer plate into the threads of the electrical power receptacle; each retainer screw having a shank with a diameter smaller than the opening of one of the retainer holes and each retainer screw also having a head with a diameter larger than the opening of one of the retainer holes.

12. The retainer of claim 7, wherein a length of the retainer plate is less than a length of the electrical power receptacle, and a width of the retainer plate is less than a width of the electrical power receptacle.

13. The retainer of claim 7, wherein the retainer plate is substantially planar.

14. The retainer of claim 7, wherein:

the cord hole through the retainer plate is in an interior portion of the retainer plate; and the cord hole through the retainer plate is centered in the retainer plate.

15. A retainer for maintaining connection of an electrical plug at an end of an electrical power cord to an electrical power receptacle, said retainer comprising:

a retainer plate;

a cord hole through the retainer plate;

a slot through the retainer plate from an edge of the retainer plate to the cord hole through the retainer plate;

retainer screws sized to engage threads of the electrical power receptacle and extend through the retainer plate into the threads of the electrical power receptacle; and retainer holes through the retainer plate, each retainer hole having a dimension that is larger than a diameter of a shank of one of the retainer screws and less than a diameter of a head of one of the retainer screws, wherein the cord hole is between at least two retainer holes.

16. The retainer of claim 15, wherein:

the retainer plate is resiliently deformable;

the slot through the retainer plate has a minimum dimension that is less than a minimum dimension of the electrical power cord; and the cord hole through the retainer plate has a minimum dimension that is greater than the minimum dimension of the slot through the retainer plate and less than a maximum dimension of the electrical power plug at the end of the electrical power cord.

17. The retainer of claim 15, wherein:

the retainer plate is rigid;

the slot through the retainer plate has a minimum dimension that is at least as great as a maximum dimension of the electrical power cord and less than a maximum dimension of the electrical power plug at the end of the electrical power cord; and the cord hole through the retainer plate has a minimum dimension that is greater than the minimum dimension of the slot through the retainer plate and less than a maximum dimension of the electrical power plug at the end of the electrical power cord.

18. The retainer of claim 15, wherein when plug is in electrical power receptacle, the electrical cord is in the cord hole, and at least two retaining straps are extending from the retainer plate around the electrical power receptacle and back to the retaining plate, one of the at least two retaining straps extends across the slot through the retainer plate.

19. The retainer of claim 15, further comprising:

at least two retaining straps, each retaining strap operable to engage one or more of the retainer holes hole or one or more retaining strap notches in the retainer plate and extend from the retainer plate around the electrical power receptacle and back to the retainer plate, wherein the retaining strap is one of a cable tie and a hook and loop fastener.

20. The retainer of claim 15, wherein:

a length of the retainer plate is less than a length of the electrical power receptacle, and a width of the retainer plate is less than a width of the electrical power receptacle;

the retainer plate is substantially planar;

the cord hole through the retainer plate is in an interior portion of the retainer plate; and the cord hole through the retainer plate is centered in the retainer plate.

* * * * *